US007320634B1

(12) United States Patent
Minick

(10) Patent No.: US 7,320,634 B1
(45) Date of Patent: Jan. 22, 2008

(54) SANDING TOOL AND DUST COLLECTION SYSTEM THEREFOR

(75) Inventor: Chris A. Minick, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/565,987

(22) Filed: Dec. 1, 2006

(51) Int. Cl.
*B24B 23/00* (2006.01)

(52) U.S. Cl. ..... 451/344; 451/354; 451/456; 451/523; 451/525

(58) Field of Classification Search ..... 451/344, 451/354, 356, 523, 524, 525, 456
See application file for complete search history.

(56) References Cited

U.S. PATENT DOCUMENTS

| | | | | | |
|---|---|---|---|---|---|
| 1,145,134 | A * | 7/1915 | Fowler | ..... | 451/522 |
| 1,455,559 | A * | 5/1923 | Wright et al. | ..... | 451/522 |
| 2,662,353 | A * | 12/1953 | Bergman et al. | ..... | 451/494 |
| 3,827,194 | A * | 8/1974 | Hutchins | ..... | 451/357 |
| 4,697,389 | A * | 10/1987 | Romine | ..... | 451/354 |
| 4,964,243 | A * | 10/1990 | Reiter | ..... | 451/354 |
| 5,540,616 | A * | 7/1996 | Thayer | ..... | 451/354 |
| 6,059,850 | A | 5/2000 | Lise et al. | | |
| 6,379,237 | B1 * | 4/2002 | Gordon | ..... | 451/523 |
| 6,699,112 | B2 * | 3/2004 | Bergner et al. | ..... | 451/357 |
| 6,780,094 | B2 * | 8/2004 | Walker | ..... | 451/356 |
| 7,040,973 | B1 * | 5/2006 | Kitts | ..... | 451/533 |
| 7,118,609 | B2 * | 10/2006 | Valentini | ..... | 55/385.1 |
| 2006/0199484 | A1 | 9/2006 | Brown | | |

* cited by examiner

*Primary Examiner*—Eileen P. Morgan
(74) *Attorney, Agent, or Firm*—David B. Patchett

(57) ABSTRACT

A hand-held manually-operated sanding tool includes a base having a lower surface including a plurality of attachment posts extending outwardly therefrom and a handle opposite the base lower surface for a user to grasp and maneuver the tool.

14 Claims, 2 Drawing Sheets

SANDING TOOL AND DUST COLLECTION SYSTEM THEREFOR

BACKGROUND

The present invention relates generally to sanding tools and, more particularly, to hand-held, manually-operated sanding tools for use with resilient abrasive articles such as sanding sponges.

Sanding sponges are commonly used to hand sand or finish a work surface, such as drywall or wood. Sanding sponges are commercially available from 3M Company, St. Paul, Minn. under the trade designation 3M Sandblaster sanding sponge. Sanding sponges are also known in the patented prior art. U.S. Pat. No. 6,059,850 (Lise et al.), for example, discloses a resilient abrasive article including a resilient elongatable substrate, abrasive particles adhesively bonded to the substrate with a flexible make coat, and a hard size coat applied over the abrasive particles and the flexible make coat.

In hand sanding, the user holds the sanding sponge directly in his or her hand to move the sanding sponge across the work surface. Sanding by hand can, or course, be an arduous task. To facilitate the hand sanding process, the sanding sponge may be placed in a holder. Holders can be readily grasped by a user to make hand sanding faster and easier. Holders for sanding sponges are known in the patented prior art. U.S. Pat. No. 6,378,237 (Gordon), for example, discloses a holder for releasably retaining an abrasive sponge. The holder comprises a base for holding the sponge therein, the base having a top surface and surfaces depending downwardly from the top surface to border the sponge partially along at least three of its sides, and a handle releasably connected to the top surface of the base.

To collect dust generated during sanding, sanding tools have been developed that can be connected with a vacuum device. U.S. Patent Publication No. 2006/0199484 (Brown), for example, discloses a resilient sanding block of the type comprising a core having a plurality of exterior surfaces, including a first major surface and a second major surface and side surfaces, and having a layer of abrasive material disposed thereon. The resilient sanding block may have one or more apertures or through holes extending from one major surface to the other major surface and channels formed in at least one of the major surfaces, with the channels in communication with the aperture. When a vacuum source is operatively connected to the aperture, the dust created by sanding will be substantially removed into the vacuum source via the channels and the aperture. A holder for a resilient sanding block is also disclosed, as well as a handle for the holder, which together form a sanding system.

Known sanding tools suffer from one or more drawbacks or shortcomings. For example, known sanding tools may be heavy, difficult or cumbersome to use, may be expensive or difficult to manufacture, or may lack durability; the holder may interfere with the use of the abrasive article and prevent the abrasive article from sanding adjacent an edge, may not securely hold the sanding sponge, or can only be used with a sanding sponge having a certain defined size and shape; and/or the vacuum collection system may clog quickly, may create an objectionable amount of noise, or may not collect the desired quantity of dust generated during the sanding operation.

It would be desirable to provide a sanding tool that is lightweight, easy to make and use, durable, quiet, does not clog quickly, can be used with sanding sponges having a variety of shapes and sizes, and allows the abrasive article to be sand adjacent an edge.

SUMMARY

The present invention provides a hand-held, manually-operated sanding tool comprising a base having a lower surface including a plurality of attachment posts extending outwardly therefrom, and a handle opposite the base lower surface for a user to grasp and maneuver the tool.

In one embodiment, the sanding tool includes an abrasive article removably secured to the base adjacent the lower surface. In one aspect, the abrasive article contains openings sized to received and matingly engage the attachment posts, thereby connecting the abrasive article with the tool. In another aspect, the openings are through-bores that extend from one major surface of the abrasive article to the opposite major surface. In other aspects, the abrasive article may be a resilient abrasive article, the abrasive article may be a rectangular prism having at least four abrasive side surfaces, the abrasive article may comprise a foam substrate with abrasive particles adhered to the substrate, and the abrasive article may have a thickness greater than the length of the attachment posts.

In various specific embodiments, the attachments posts may be rigid hollow cylinders having a diameter of greater than about ⅛ of an inch and a length of greater than about ⅛ of an inch, the lower surface of the tool m ay include between 4 and 10 attachment posts, the attachment posts may be arranged in a pair of rows, and the entire peripheral edge of the base may be contained within the peripheral edge of the abrasive article.

In another embodiment, the tool may contain a dust collecting network for gathering, containing and transporting dust and debris from the abraded surface to a remote collection device. The base may contain a manifold, and the attachment posts contain dust collecting inlet ports in fluid communication with the manifold.

In addition, the handle may include a conduit in fluid communication with the manifold, and the handle may include an outlet port at the end of the conduit opposite the manifold for connection with a vacuum source, thereby to draw dust from the abraded work surface through the inlet ports, through the attachment posts, into the manifold, through the conduit, through the outlet port, and into a remote collection device. In another aspect, the sanding tool may include an extension pole connected with the handle.

In another aspect, the present invention provides a sanding system comprising hand-held, manually-operated sanding tool including a base having a lower surface including a plurality of attachment posts extending outwardly therefrom and a handle opposite the base lower surface for a user to grasp and maneuver the tool, a cyclone separation device connected with the sanding tool, and a vacuum source connected with the cyclone separation device. The cyclone separation device may include a top including inlet and outlet ports, and a bottom having a collection chamber for collecting dust and debris separated from the contaminated fluid stream entering the cyclone separation device. In another aspect, the cyclone separation device is connected with the sanding tool with a flexible hose having a smooth inner surface.

Advantages of certain embodiments include the ability to finish a surface in the region immediately adjacent an edge, that the tool can be lightweight, easy to make and use, durable, quiet, and does not clog quickly, and that sanding sponges having a variety of shapes and sizes can be used with the tool.

BRIEF DESCRIPTION OF THE DRAWINGS

The present invention will be further described with reference to the accompanying drawings, in which.

DETAILED DESCRIPTION

Figure 1:
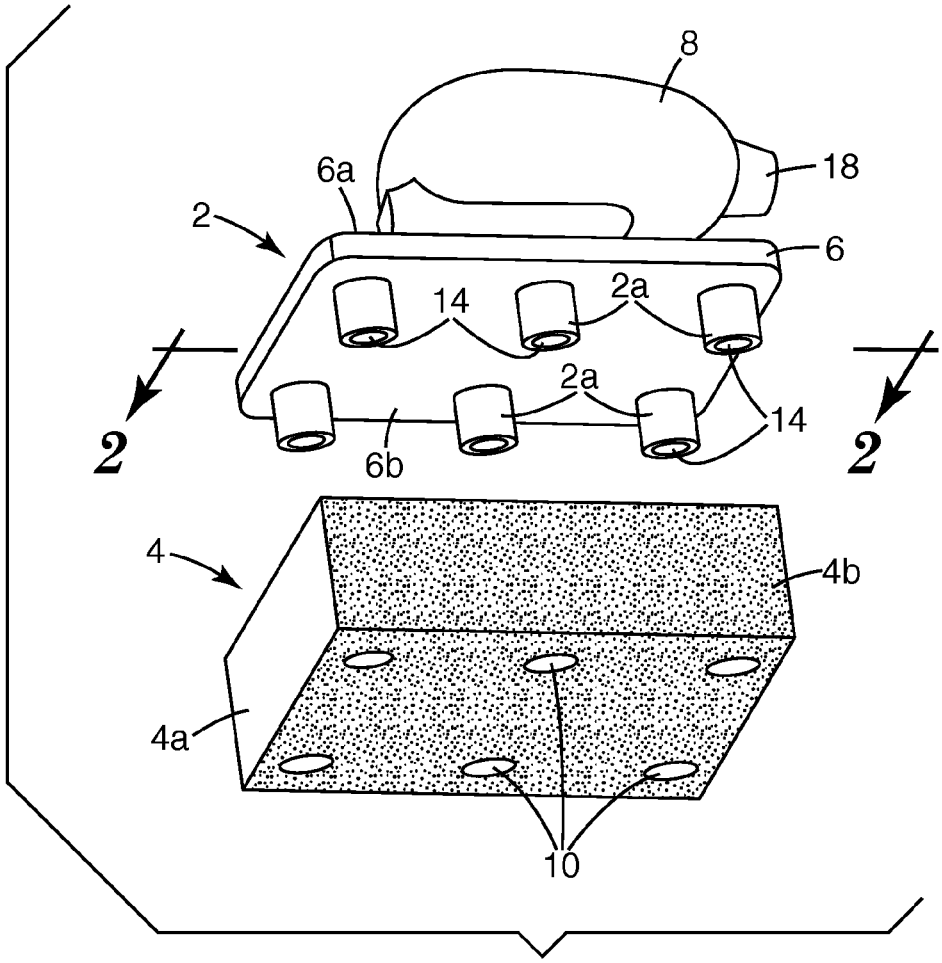
FIG. 1 is an exploded perspective view of a sanding tool according to the invention.
Figure 2:
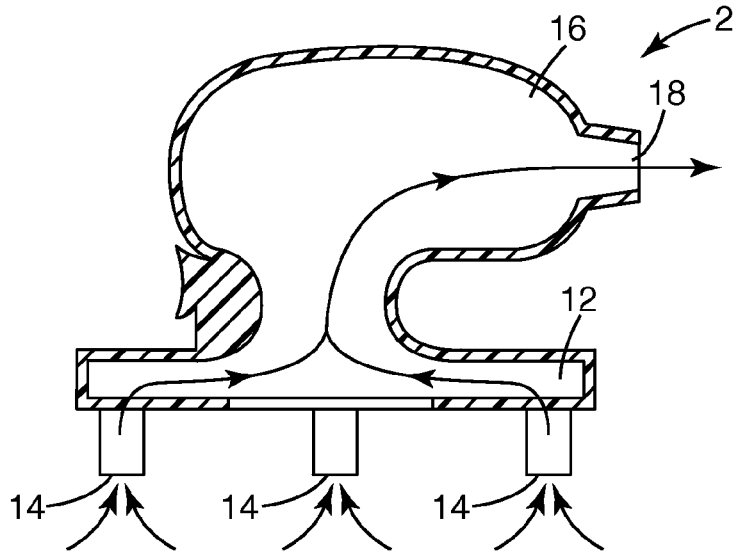
FIG. 2 is cross-sectional side view taken along 2-2 of FIG. 1.

Referring now to the drawings, wherein like reference numerals refer to like or corresponding parts throughout the several views, FIGS. 1 and 2, show a hand-held, manually-operated sanding tool 2, and a resilient abrasive article in the form of a sanding sponge 4 removably attached to the sanding tool 2. The term "manually-operated" refers to the fact that the tool 2 is not a power tool. That is, all of the power needed to operate the tool 2 is provided by a user (not shown), and the tool 2 itself does not include a motor. It will be recognized, however, that principles of the present invention may be applied to a power tool and are not necessarily limited to manually-operated sanding tools.

The sanding tool 2 generally includes a base 6 having opposed upper 6*a* and lower 6*b* surfaces, and a handle 8 extending from the upper surface 6*a* that can be grasped by a user, and thereby allow the user to move the maneuver the sanding tool 2 to perform manual sanding. In the illustrated embodiment, the base 6 is generally rectangular, and the lower surface 6*b* of the base 6 includes a generally planar interior surface region. In accordance with a characterizing aspect of the sanding tool 2, a plurality of attachment posts 2*a* extend outwardly from the lower surface 6*b* of the base 6 opposite the handle 8. As described more fully below, the attachment posts 2*a* serve to removably secure the sanding sponge 4 to the sanding tool 2 adjacent the lower surface 6*b* of the base 6.

The length of the attachment posts 2*a* is less than the thickness of the sanding sponge 4. In this manner, when the sanding sponge 4 is placed on the sanding tool 2, the attachment posts 2*a* are contained within and concealed by the sanding sponge 4. That is, no portion of the attachment posts 2*a* extend through the sanding sponge 4. In the illustrated embodiment, the attachment posts 2*a* are rigid hollow cylinders. The attachment posts 2*a* typically have a diameter of greater than about ⅛ inch and a length of greater than about ⅛ inch. Attachment posts 2*a* having other shapes and sizes are within the scope of the invention. The attachment posts 2*a* are typically hollow to allow for the collection of dust as described below, but they may also be solid.

To prevent the sanding sponge 4 from rotating when it is secured to the sanding tool 2, the sanding tool is provided with at least two attachment posts 2*a*. That is, by providing the sanding tool 2 with at least two attachment posts 2*a*, the sanding sponge 4 cannot rotate relative to the sanding tool 2 without damaging either the sponge 4 or the tool 2. In addition, to provide a more secure attachment, the attachment posts 2*a* are typically evenly spaced or evenly distributed on the lower surface 6*b* of the base 6. The number, size and arrangement of attachment posts 2*a* is not significant to the invention hereof, so long as it provides a sufficiently secure connection between the sanding tool 2 and the sanding sponge 4. The sanding tool typically includes between four and ten attachment posts 2*a*.

The sanding sponge 4 contains a plurality of openings 10 arranged and sized to receive and matingly engage the attachment posts 2*a*, thereby to form a compression or friction fit attachment with the sanding tool 2. In the illustrated embodiment, the base includes six attachment posts 2*a* arranged in a pair of rows, and the sanding sponge 4 contains six corresponding openings 10 that form the compression or friction fit around each of the associated attachments posts 2*a*. In this manner, a user can readily remove the sanding sponge 4 from the sanding tool 2 and either clean the sanding sponge 4 or replace it with a new sanding sponge.

In the illustrated embodiment, the openings 10 are through-bores the extends from one major surface of the sanding sponge 4 to the opposite major surface, thereby allowing dust and debris to be drawn into the openings 10 and through the sanding sponge 4. If the sanding tool 2 is to be used as a holder only—and not as part of a dust collecting system—the openings 10 need not extend through the sanding sponge 4. That is, the openings 10 may be cavities or holes that extend only partially into the sanding sponge 4. The sanding sponge 4 generally includes a foam substrate 4*a* with abrasive particles 4*b* adhered to the substrate 4*a*. In the illustrated embodiment, the sanding sponge 4 has the shape of a rectangular prism. Abrasive particles are provided on the top, bottom and side surfaces of the sanding sponge 4, and the end surfaces of the sanding sponge 4 are generally free of abrasive particles. Any sanding sponge having at least one abrasive surface is contemplated in connection with the present invention.

One advantage of forming the connection between the sanding tool 2 and the sanding sponge 4 using attachment posts 2*a*—rather than a shroud-type of holder—is that the friction fit connection is formed entirely within the interior body of the sanding sponge 4. That is, the sanding sponge 4 is arranged over the attachment posts 2*a*, thereby removably connecting the sanding sponge 4 with the sanding tool 2. In this manner, the sanding tool 2 may be designed so that the entire peripheral edge of the base 6 is contained within the peripheral edge of the sanding sponge 4. In this manner, the entire perimeter of the sanding sponge 4 remains free and unencumbered such that the sanding tool 2 does not interfere with the user's ability to sand a work surface immediately adjacent to an edge. The compression fit formed by the attachment posts 2*a* within the body of the sanding sponge 4 does not utilize the perimeter side surfaces of the sanding sponge 4, and by not utilizing the perimeter of the sanding sponge 4, the attachment posts 2*a* do not interfere with the sanding of a work surface that abuts another surface. Stated another way, by providing an internal connection, the outer edge of sanding sponge 4 remains exposed so that the sanding sponge 4 can be maneuvered directly into contact with a wall surface adjacent the work surface being sanded.

In addition, by providing an internal connection interface rather than a connection interface that utilizes the perimeter of the sanding sponge, sanding sponges of different sizes and shapes can be secured to the sanding tool, so long as the sanding sponges are provided with openings that otherwise match the size, shape and arrangement of the attachment posts 2*a* provided on the sanding tool 2.

In the illustrated embodiment, the sanding tool 2 contains a dust collection network for gathering, containing and transporting dust and debris from the abraded work surface to a remote collection and storage device, described in greater detail below. The base 6 contains a manifold 12, and the attachment post 2*a* are hollow and contain dust collecting inlet ports 14 that are in fluid communication with the manifold 12, and the handle 8 contains a conduit 16 that extends in fluid communication from the manifold 12 to an outlet port 18. The outlet port 18 may be connected with a vacuum source 20 (FIG. 3) via a hose 22 to draw dust and debris from the abraded work surface, through the inlet ports 14, through the attachment posts 2*a*, into the manifold 12, though the handle 8 via the conduit 16, through the outlet port 18, and into a remote collection and storage system. The remote collection and storage system may be the vacuum source 20 itself, which may be a conventional wet/dry-type shop vacuum, or it may further include a separator such as the cyclone separation device 24 described below.

Figure 3:
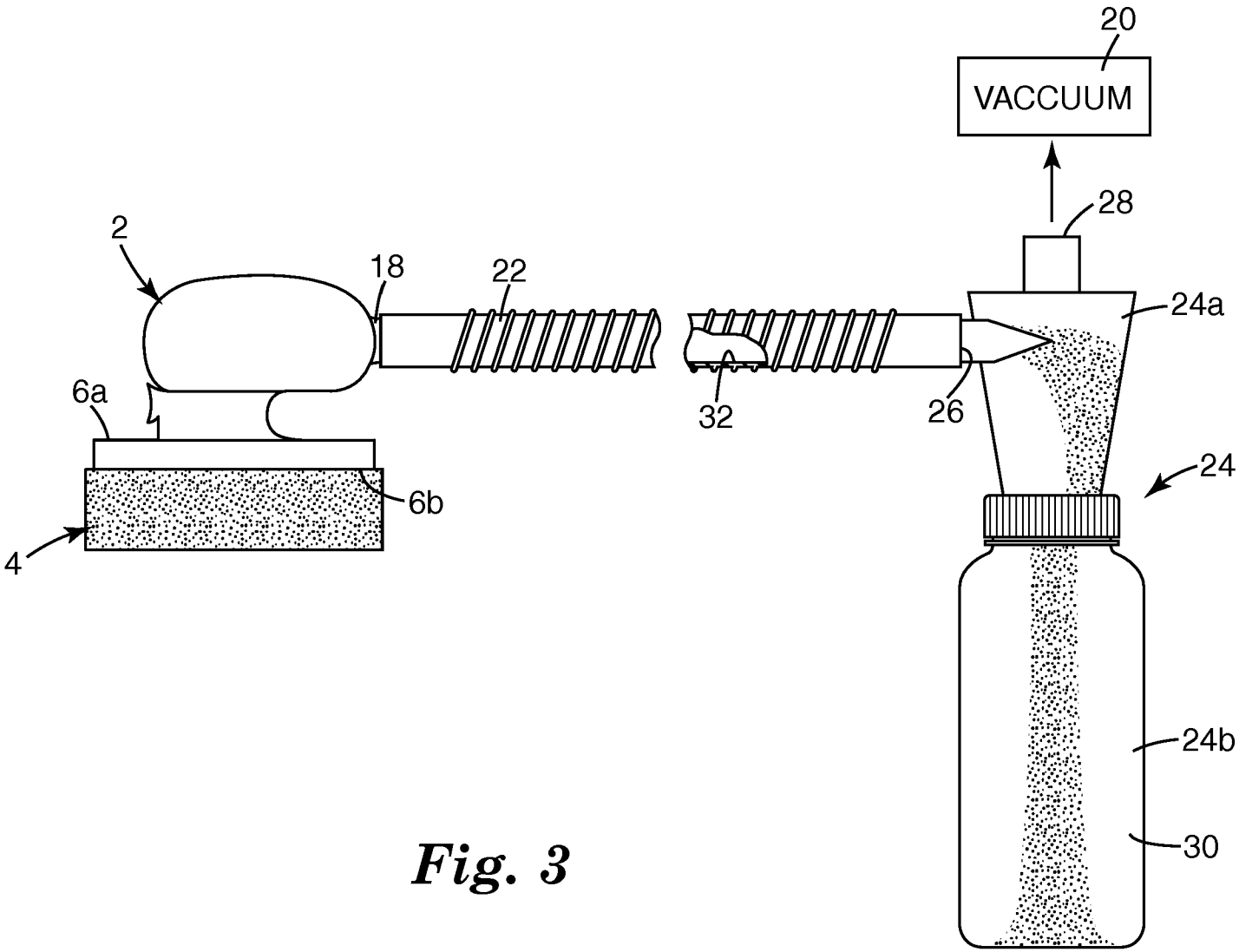
FIG. 3 is a diagrammatic illustration of a cyclone separation device that can from part of a dust collecting sanding a system.

Referring now to FIG. 3, there is shown a cyclone separation device 24 that can be connected between the sanding tool 2 and the vacuum source 20 to form a dust collection and storage system. One shortcoming of sanding tools with dust collecting capability is that the vacuum source tends to clog quickly. Conventional vacuum sources, for example, typically include a dead-end type filter that removes contaminants from the air stream by forcing the air through the filter. Because of the large quantity of dust generated during most sanding operations, such filters clog quickly. The cyclone separation device 24 overcomes his shortcomings by removing a large majority of the contaminants entrained in the air stream before it reaches the vacuum source, thereby significantly increasing the life of the filter in the vacuum source.

Other dust collection networks are contemplated in connection with the present invention. For example, rather than having the dust laden fluid stream travel through the handle 8 to the outlet port 18, the upper surface 6*a* of the base 6 may include an outlet port that may be connected with a vacuum source 20.

According to another characterizing aspect of the sanding system, the cyclone separation device 24 is connected with the sanding tool 2 and the vacuum source 20 with a flexible hose 22 having a smooth inner surface. The sound level generated by conventional hoses having corrugated inner surfaces tends to objectionable when operated at flow rates typically needed to achieve a desirable level of dust collection. Hoses having smooth inner surfaces, it has been found discovered, are much quieter when operated at the same flow rates. A suitable hose having a smooth inner surface is available from A-M Systems, Inc., Carlsborg, Wash. having a diameter of 15 mm.

The cyclone separation device 24 generally includes a top portion 24*a* having a side inlet port 26 and a top outlet port 28, and a bottom portion 24*b* having a collection chamber 30 for collecting dust and debris that has been removed from the contaminated air stream entering the cyclone separation device 24. To allow for easy cleaning, the collection chamber 30 is threadably connected with the top portion 24*a*. In one desirable embodiment of the invention, the top portion 24*a* of the cyclone separation device 24 had an upper diameter $D_0$ of about 75 mm, a lower diameter $D_1$, of about 35 mm, and a height H of about 140.

When operated at a volumetric flow rate of 75 cubic feet per minute (efm), this cyclone separation device removed approximately 98% by weight of the contaminant in an incoming air stream produced by a 60 grit 3M Sandblaster sanding sponge while sanding a wooden surface. The cyclone separation device 24 is typically small and light enough to be portable (i.e. carried by the user), but it may also be combined with the vacuum source and used as a more stationary accessory.

Persons of ordinary skill in the art may appreciate that various changes and modifications may be made to the invention described above without deviating from the inventive concept. For example, the sanding tool 2 may be connected with an extension pole for sanding hard to reach areas. In addition, the sanding tool may comprise an interface pad removably secured to the lower surface of the base 6 via the attachment posts 2*a*, and a sheet-like abrasive may be removably secured to the interface pad. Thus, the scope of the present invention should not be limited to the structures described in this application, but only by the structures described by the language of the claims and the equivalents of those structures.

What is claimed is:

1. A hand-held, manually-operated tool for use with a removable abrasive article, comprising:

(a) a base having a lower surface including a plurality of attachment posts extending outwardly therefrom such that the abrasive article may be removably secured to the tool, wherein the base contains a manifold, and the attachment posts contain dust collecting inlet ports in fluid communication with the manifold; and (b) a handle opposite the base lower surface for a user to grasp and maneuver the tool.

2. A tool as defined in claim 1, wherein the abrasive article contains openings sized to receive and matingly engage the attachment posts, thereby connecting the abrasive article with the tool.

3. A tool as defined in claim 2, wherein the openings are through-bores extending from one major surface of the abrasive article to the opposite major surface.

4. A tool as defined in claim 3, wherein the abrasive article is a resilient abrasive article.

5. A tool as defined in claim 4, wherein the abrasive article is a rectangular prism having at least four abrasive side surfaces.

6. A tool as defined in claim 5, wherein the abrasive article comprises a foam substrate with abrasive particles adhered to the substrate.

7. A tool as defined in claim 6, wherein the abrasive article has a thickness greater than the length of the attachment posts.

8. A tool as defined in claim 7, wherein the attachments posts are rigid hollow cylinders having a diameter of greater than about ⅛ of an inch and a length of greater than about ⅛ of an inch.

9. A tool as defined in claim 8, wherein the lower surface of the tool includes between 4 and 10 attachment posts.

10. A tool as defined in claim 1, wherein the attachment posts are arranged in a pair of rows.

11. A tool as defined in claim 1, wherein the entire peripheral edge of the base is contained within the peripheral edge of the abrasive article.

12. A tool as defined in claim 1, wherein the tool contains a dust collecting network for gathering, containing and transporting dust and debris from the abraded surface to a remote collection device.

13. A tool as defined in claim 1, wherein the handle includes a conduit in fluid communication with the manifold, and further wherein the handle includes an outlet port at the end of the conduit opposite the manifold for connection with a vacuum source, thereby to draw dust from the abraded work surface through the inlet ports, through the attachment posts, into the manifold, through the conduit, through the outlet port, and into a remote collection device.

14. A tool as defined in claim 1, further comprising an extension pole connected with the handle.

* * * * *

UNITED STATES PATENT AND TRADEMARK OFFICE

CERTIFICATE OF CORRECTION

PATENT NO. : 7,320,634 B1
APPLICATION NO. : 11/565987
DATED : January 22, 2008
INVENTOR(S) : Chris A. Minick It is certified that error appears in the above-identified patent and that said Letters Patent is hereby corrected as shown below:

Column 1
Line 27, delete "6,378,237" and insert -- 6,379,237 --, therefor.

Column 2
Line 11 (approx.), delete "received" and insert -- receive --, therefor.

Column 3
Line 6, delete "from" and insert -- form --, therefor.
Line 7, before "system." Delete "a".
Line 25, after "move" delete "the" and insert -- and --, therefor.

Column 5
Line 43, (approx.), delete "$D_0$" and insert -- $D_U$ --, therefor.
Line 43 (approx.), delete "$D_1$" and insert --$D_L$ --, therefor.
Line 46 (approx.), delete "(efm)," and insert -- (cfm), --, therefor.

Signed and Sealed this

Twenty-fourth Day of June, 2008

JON W. DUDAS
*Director of the United States Patent and Trademark Office*